United States Patent [19]

Grigsby

[11] Patent Number: 4,586,627

[45] Date of Patent: May 6, 1986

[54] REINFORCED BULK MATERIAL CONTAINER

[75] Inventor: John M. Grigsby, Marietta, Ga.

[73] Assignee: North American Container Corporation, Mableton, Ga.

[21] Appl. No.: 652,673

[22] Filed: Sep. 21, 1984

[51] Int. Cl.[4] ..... B65D 5/32; B65D 5/56

[52] U.S. Cl. ..... 220/443; 220/441; 229/23 C

[58] Field of Search ..... 220/441, 443; 229/DIG. 4, 23 C; 493/96, 374

[56] References Cited

U.S. PATENT DOCUMENTS

| | | | |
|---|---|---|---|
| 1,987,225 | 1/1935 | Bergstein | 229/DIG. 4 X |
| 2,277,674 | 3/1942 | Belsinger | 229/23 C |
| 2,693,894 | 11/1954 | Elmendorf | 229/23 C X |
| 2,910,221 | 10/1959 | Whiton | 220/441 X |
| 2,949,151 | 8/1960 | Goldstein | 229/DIG. 4 X |
| 3,159,326 | 12/1964 | Stonebanks | 229/23 C X |
| 3,910,482 | 10/1975 | Bamburg et al. | 220/443 X |
| 4,177,935 | 12/1979 | Centanni | 220/443 X |
| 4,260,442 | 4/1981 | Ford et al. | 229/DIG. 4 X |

FOREIGN PATENT DOCUMENTS

| | | | |
|---|---|---|---|
| 538727 | 6/1955 | Belgium | 220/441 |

*Primary Examiner*—Allan N. Shoap

*Attorney, Agent, or Firm*—Jones & Askew

[57] ABSTRACT

A reinforced container for bulk pack materials wherein a first blank of paperboard is bonded to a second blank of paperboard. A plurality of support members are fixedly secured between the first blank and second blank of paperboard so as to reinforce the container. The support members are preferably formed of wood and positioned near the corners of the container.

3 Claims, 5 Drawing Figures

REINFORCED BULK MATERIAL CONTAINER

TECHNICAL FIELD

The present invention relates to containers formed from corrugated paperboard and, more particularly, relates to a reinforced container for shipping and storing bulk materials.

BACKGROUND OF THE INVENTION

Containers made of corrugated paperboard have long been used for shipping and storing a variety of bulk materials such as powders, tobacco, metal castings, plastic resins, peanuts and many other materials. Such materials are often poured or thrown into the container and shipped loose so that the packed materials flow within the container. The side walls of the container must therefore be sufficiently rigid to withstand the internal movement of the load. Additionally, because it is often desired to stack one container directly on top of another for storage, the side walls must provide sufficient compression strength to prevent deformation or collapse of the container.

Various prior art containers have been provided in attempts to meet these requirements. Bulk pack containers have been provided with side walls formed of two and three layers of corrugated paperboard laminated together. Other containers have been provided having a multiple-cell construction or a center partition in an effort to decrease the internal movement of the bulk materials.

Even so, many problems still exist with these and other prior art containers. For example, in an effort to achieve the desired sidewall rigidity and compression strength, many prior art containers have been formed with a corrugated paperboard of increased weight and density. Yet, because all paper absorbs moisture, such containers lose their rigidity and compression strength when kept in a humid environment for an extended period of time. A warehouse typically provides just such an environment. As a result, these containers often deform and collapse, causing damage to the contents stored within. For the same reasons, multi-celled and partitioned containers have also proved ineffective.

Another prior art attempt has been to secure several layers of paperboard together using a moisture resistant adhesive. Because the paperboard is still subject to water absorption, such methods have proved only minimally effective. Additionally, the cost of these water resistant adhesives and the cost of applying these adhesives to the paperboard are extremely high.

Yet another prior art attempt to improve such containers requires manually inserting posts into the corners of the container. These posts are often formed of laminated paperboard, wood, metal or some other rigid material. While corner posts are very effective when used with a unit load container, they are ineffective when used with a bulk pack container. Because the bulk material will flow into the corners of the container, the act of inserting a post in the corner often causes damage to the bulk material. Furthermore, any movement of the packed material during shipment can dislodge the posts from the corners, rendering them useless as support members. Such movement of the bulk material can also break or splinter the corner posts, thereby contaminating the bulk material packed in the container. Yet another problem with corner posts in a bulk pack container is that by their very presence they decrease the amount of usable volume within the container. Furthermore, such hand placed posts increase the cost of manufacturing the container as a result of the additional labor required.

Thus, the prior art has heretofore lacked a bulk material container that provided the desired side wall rigidity and compression strength even under conditions of high humidity and heat.

SUMMARY OF THE INVENTION

The present invention solves the above-described problems in the prior art by providing a reinforced bulk container that provides and maintains sufficient side wall rigidity and compression strength even under hot and humid conditions. Furthermore, the present invention provides a cost effective method of forming a reinforced bulk material container according to the present invention.

Generally described, a reinforced bulk material container according to the present invention comprises an outer wall-forming blank of paperboard, an inner wall-forming blank of paperboard, and a plurality of support members fixedly retained between the outer wall-forming blank and the inner wall-forming blank so as to maintain the top-to-bottom compression strength and the side wall strength of the container.

Described more particularly, a reinforced bulk material container according to the present invention comprises a first wall-forming blank of corrugated paperboard scored to provide a series of wall panels foldably joined together, a second wall-forming blank of corrugated paperboard scored to provide a series of wall panels foldably joined together, the second wall-forming blank being formed for bonding to the inside of the first wall-forming blank so as to form a series of side walls, and a plurality of support members fixedly retained between the first wall-forming blank and the second wall-forming blank, each of the plurality of the support members extending substantially the height of the second blank so as to increase and maintain the strength of the sidewalls when several containers have been stacked for shipment or storage.

Generally described, the method of the present invention comprises the steps of forming an outer shell from a first blank of paperboard, forming an inner liner from a second blank of paperboard, bonding a plurality of support members to the inner liner, and bonding the inner liner to the outer shell so as to fixedly retain the support members between the outer shell and the inner liner.

Thus, it is an object of the present invention to provide an improved reinforced bulk material container.

It is a further object of the present invention to provide a reinforced bulk material container of increased side wall rigidity and compression strength.

It is a further object of the present invention to provide a reinforced bulk material container that maintains its side wall rigidity and compression strength under conditions of high heat and humidity.

It is a further object of the present invention to provide a reinforced bulk material container capable of multiple stacking during shipment or storage.

It is a further object of the present invention to provide a reinforced bulk material container that does not decrease the volume of usable space within the container.

It is yet a further object of the present invention to provide a less expensive reinforced bulk material container in terms of decreased container construction cost and less product damage.

It is a further object of the present invention to provide a method of forming a reinforced bulk material container that provides an increased side wall rigidity and compression strength.

It is a further object of the present invention to provide a method of forming a reinforced bulk material container that is cost effective.

These and other objects, features and advantages of the present invention will become apparent from a reading of the following specification in conjunction with the accompanying drawings.

DETAILED DESCRIPTION

Figure 1:
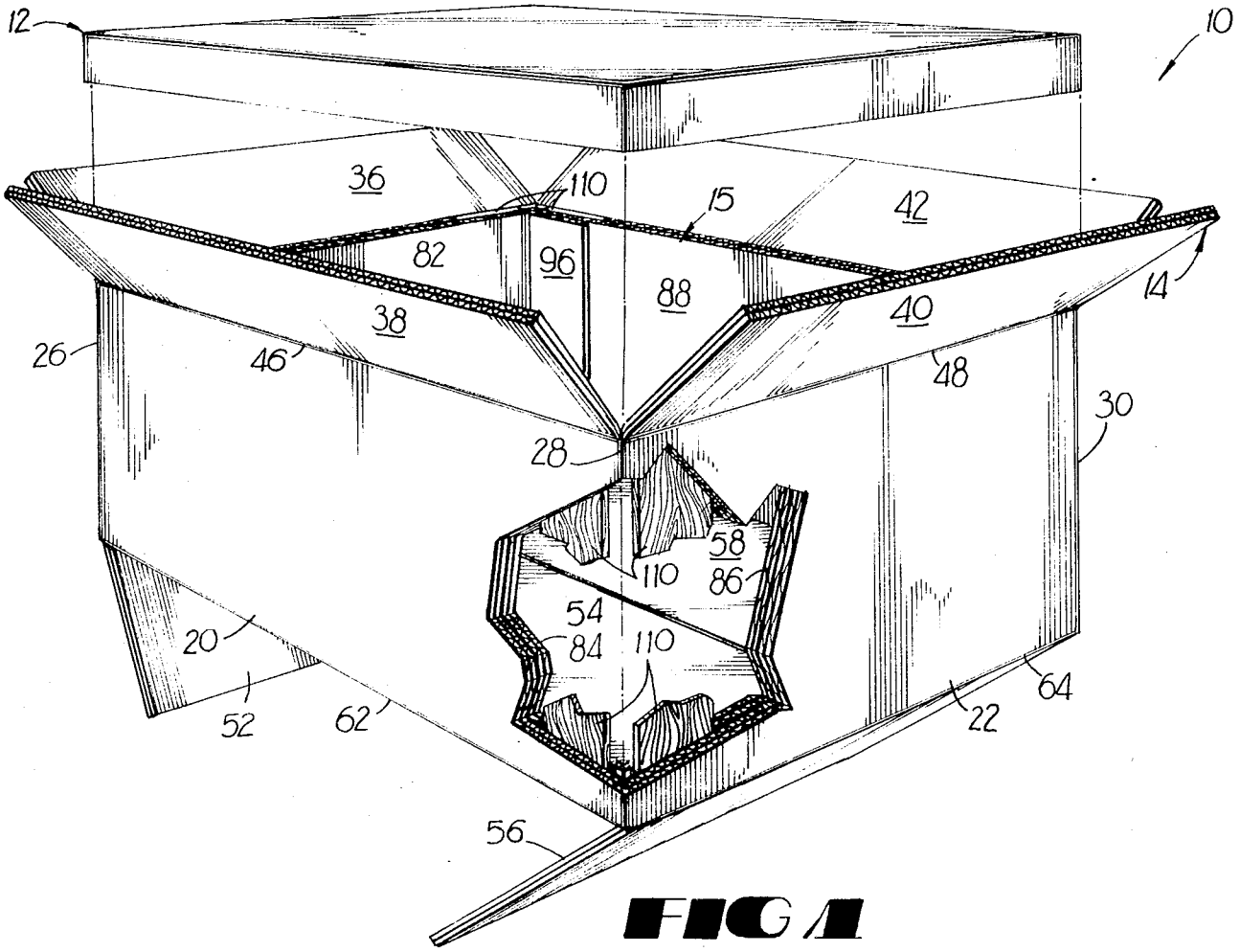
FIG. 1 is a pictorial view of a preferred embodiment of a reinforced bulk material container according to the present invention, with a portion of the container cut away to show a support member.

Referring now in more detail to the drawing, in which like numerals indicate like parts throughout the several views, FIG. 1 shows the preferred embodiment of a reinforced bulk material container according to the present invention generally at 10. FIG. 1 further shows a cap member 12 positioned immediately above the container 10. The cap member 12, which may be formed of any suitable material, is provided for closing off the top of the container 10. Thus, the cap member 12 is dimensioned so as to fit snugly over the top of the container 10. The details of the cap member 12 are outside the scope of the present invention and thus, need not be disclosed further herein.

Those skilled in the art will recognize that FIG. 1 shows no bottom support member such as a pallet or a slip sheet under the bottom of the container 10. Of course, various bottom support members could be provided including, but not limited to, pallets and bottom caps. Such bottom support members are well known in the art, and hence, need not be disclosed further herein. Thus, it is to be understood that the present invention has applications exclusive of conventional corrugated paperboard containers. For example, the present invention may take the form of a tube-like container consisting of only side walls with no top or bottom flaps or flanges.

Figure 2:
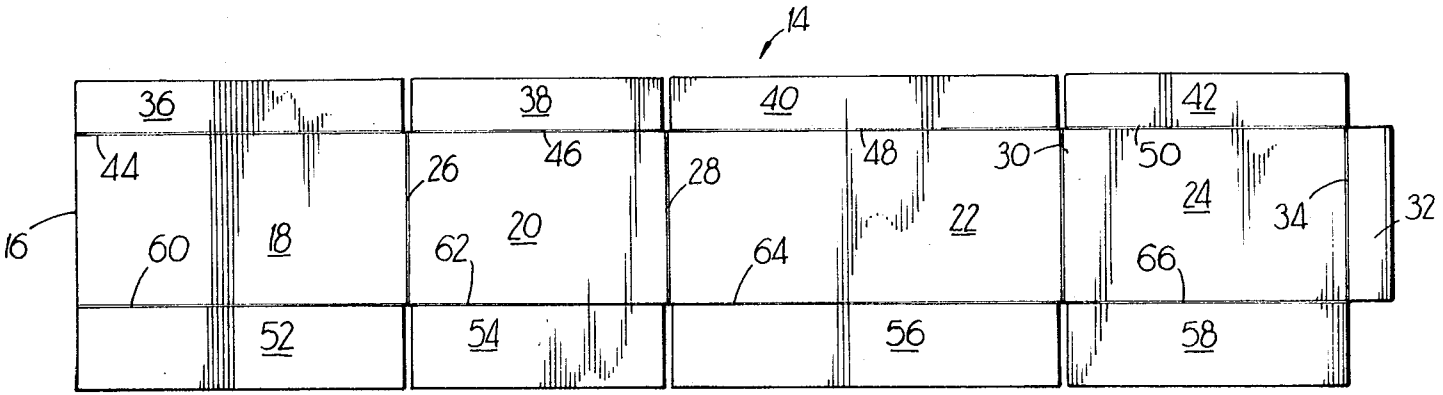
FIG. 2 is a plan view of a paperboard blank for forming the outer shell of the container shown in FIG. 1.

The preferred container 10 of the present invention is formed with an outer shell 14 and an inner liner 15. FIG. 2 shows a typical blank 16 of sheet-like material suitable for forming the outer shell 14. The preferred sheet-like material is corrugated paperboard. The outer shell blank 16 includes four main panels 18, 20, 22 and 24 foldably connected along three score lines 26, 28 and 30. The four main panels 18, 20, 22 and 24 form the four outer side walls of the container 10 as shown in FIG. 1. A manufacturer's joint flap 32 is foldably connected to the main panel 24 along a score line 34. The function of the outer shell joint flap 32 is described in greater detail hereinbelow. Those skilled in the art will appreciate that the outer shell 14 may be modified so that the manufacturer's joint flap 32 is positioned within of the container 10 instead of lapped over the outside. Such an arrangement is well known in the art, and hence, need not be disclosed further herein. A series of four top flaps 36, 38, 40 and 42 are foldably connected to the main panels 18, 20, 22 and 24, respectively, along respective score lines 44, 46, 48 and 50. Similarly, a series of four bottom flaps 52, 54, 56 and 58 are foldably connected to the main panels 18, 20, 22 and 24 along respective score lines 60, 62, 64 and 66.

Figure 5:
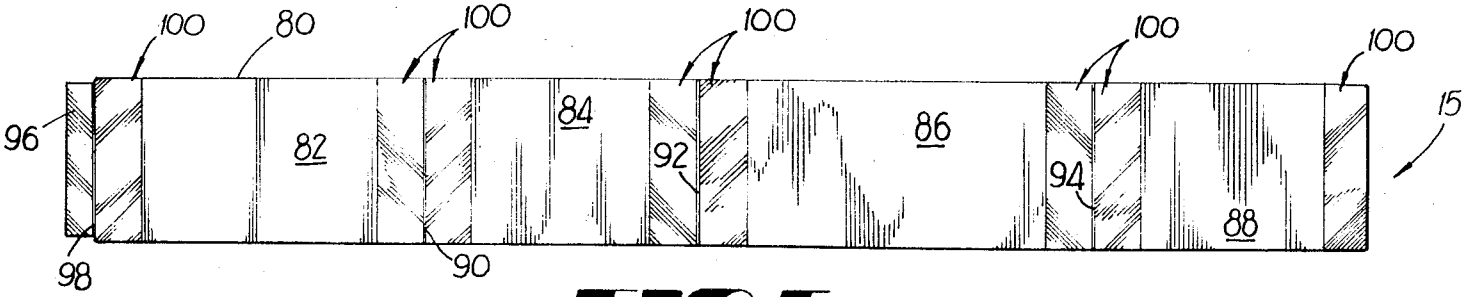
FIG. 5 is a plan view of the paperboard blank shown in FIG. 3, showing the crushed portions of the blank.

FIG. 5 shows a typical blank 80 of sheet-like material suitable for forming the inner liner 15. While other materials may be used, the preferred sheet-like material is corrugated paperboard. The inner liner blank 80 includes four main panels 82, 84, 86 and 88 foldably connected along three score lines 90, 92 and 94, respectively. The four main panels 82, 84, 86 and 88 form the four innermost side walls of the container 10 when the inner liner 15 is bonded to the outer shell 16 as described below. The inner liner blank 80 provides a joint flap 96 foldably connected to the main panel 82 along a score line 98. The left end portion and the right end portion of each main panel 82, 84, 86 and 88, as well as the joint flap 96, are crushed or otherwise deformed to facilitate bonding of the inner liner inner liner 15 to the outer shell 16. These crushed areas of the main panels 82, 84, 86 and 88 are indicated generally at 100. The crushed areas are shown in FIG. 5 by diagonal shading lines.

Figure 3:
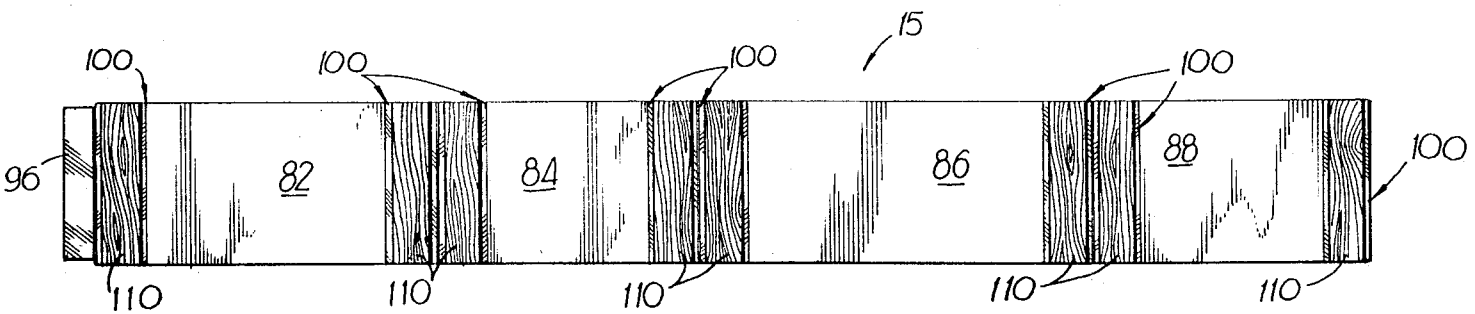
FIG. 3 is a plan view of a paperboard blank for forming the depth liner or inner wall portion of the container shown in FIG. 1, showing the reinforcing members bonded to the depth liner.

A plurality of reinforcing or support members 110 are bonded to the backside of the inner liner 15. The backside of the inner liner 15 (shown in FIG. 3 and FIG. 5) is that side of the inner liner that is to be engaged to the outer shell 14. The support members 110 may be formed of any suitably rigid material. A particularly preferred material is a wood veneer, typically ranging in thickness from $\frac{1}{8}''$ to $\frac{3}{8}''$ and in width from $2\frac{3}{4}''$ to $3\frac{3}{4}''$. The length of the support member 110 depends upon the height of the container 10. Preferably, the length of the support member 110 is substantially equal to the height of the depth liner 15, which is, in turn, substantially equal to the interior or inside height of the container 10.

A support member 110 is secured to the left and right end portion of each main panel 82, 84, 86 or 88 of the inner liner blank 80. This bonding may be done using any suitable adhesive. The support members 110 are aligned and secured vertically so to provide the maximum supporting effect when the container is erected. For reasons described in greater detail hereinbelow, the support members 110 are positioned within the crushed areas 100 of the main panels 82, 84, 86 and 88 of the depth liner blank 80. Upon erection of the container 10, this results in the support members 110 being located near the corners of the container. The support members 110 are preferably bonded as close to the corners as possible, but not so close as to prevent the container from being folded down into a substantially flat position. Additionally, in order to further increase container rigidity and compression strength, a support member 110 may be bonded near the center of otherwise intermediate of the outer ends of the main panels 82, 84, 86 or 88.

Figure 4:
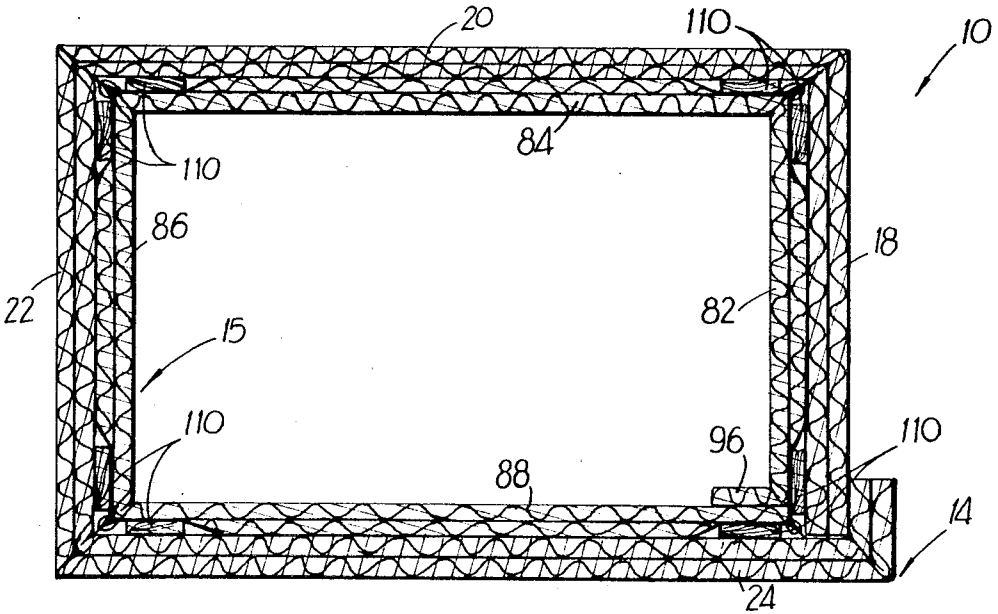
FIG. 4 is a horizontal cross-section view of the container shown in FIG. 1.

In practice of the present invention, the outer shell blank 16 and the inner liner blank 80 will initially appear as shown in FIG. 2 and FIG. 5, respectively. The outer shell blank 16 may be formed of single wall or double wall corrugated paperboard, or any other suitable material. Similarly, the inner liner blank 80 may be formed of single wall or double wall corrugated paperboard, or any other suitable material. As shown in FIG. 4, a double wall paperboard is particularly well suited for practice of the present invention. The wood veneer support members 110 are then bonded to the depth liner paperboard blank 80. More particularly, the back side of each main panel 82, 84, 86 and 88 of the depth liner blank 80 is provided with a wood veneer support member 110 at its left and right edge portion. Those skilled in the art will appreciate that the dimensions of the wood veneer support 110 (as well as the density of the paperboard) may be varied to provide a desired container strength. Those skilled in the art will further appreciate that the additional support members 110 may be added intermediate those shown at the left and right edge portions of the main panels 82, 84, 86 and 88 if the particular application of the present invention requires such.

Once the wood veneer support members are glued or otherwise bonded to the backside of the depth liner 15, the blank 80 may be bonded to the outer shell blank 16 in a conventional manner. For example, this bonding may be done by spraying, extruding or rolling an adhesive material onto either the outer shell 14 or the inner liner 15, and passing the adhesive treated blanks 16 and 30 through a compression device. Because the crushed portions of the inner liner 15 overlap the support members 110, the inside surface of the container 10 is smooth and free of any indentation that could result from the support members. This bonding operation results in a container 10 as shown in FIG. 1 and FIG. 4.

Thus, the present invention provides an improved bulk material container. The support members 110 provide the container with an increased side wall rigidity and stacking or compression strength. Because the wood veneer support members 110 resist water, the container maintains these increased strengths under hot and humid conditions. Furthermore, the retention of the wood veneer support members 110 between the outer shell 14 and the inner liner 15 in combination with the crushed portions of the inner liner results in no loss of internal container 10 volume. Additionally, the product stored within the container 10 is not disturbed or damaged by insertion of any support member and is never contacted with the support members of the present invention.

This specification has thus described a preferred embodiment of the present invention, including the steps necessary for fabricating this preferred embodiment. It is to be understood, however, that numerous changes and variations could be made in the construction of the present container within the spirit of the present invention. It should therefore be further understood that the foregoing specification relates only to a preferred embodiment of the present invention and that modifications may be made therein without departing from the scope thereof as set forth in the appended claims.

I claim:

1. A reinforced bulk material container, comprising:

a first wall-forming blank of paperboard scored to provide a series of main panels foldably joined together at a plurality of corners, said first wall-forming blank defining an inside surface and an outside surface;

a second wall-forming blank of paperboard scored to provide a series of main panels foldably joined together at a plurality of corners, said second wall-forming blank defining a front side surface and a back side surface;

a pair of independent support members glued to the backside of said second wall-forming blank at the location of each said corner, said pair of support members each extending substantially the height of said second wallforming blank and arranged so as to straddle and be spaced apart from said corner;

said back side surface of said second wall-forming blank being crushed at the location of each of said support members to accommodate the thickness of the support member and thus provide a continuous surface suitable for laminating to said first wall-forming blank; and said back side surface of said second wall-forming blank being laminated to said inside surface of said first wall forming blank so as to provide a unitary container having a series of reinforced side walls foldably joined together, whereby the interior of said container defined by said front side surface of said second wall-forming blank of paperboard provides a plurality of continuous, protrusion-free inner surfaces foldably joined together at angular corners so that said container may be collapsed into a flat condition for shipping and easily erected for filling.

2. The reinforced bulk material of claim 1, wherein said first wallforming blank of paper board further comprises a series of top flap panels and a series of bottom flap panels foldably joined to said series of main panels.

3. The reinforced bulk material container of claim 1 wherein each of said support members are made of a wood veneer material.

* * * * *